US006099688A

United States Patent [19]

Pere et al.

[11] Patent Number: 6,099,688

[45] **Date of Patent: *Aug. 8, 2000**

[54] PROCESS FOR PREPARING MECHANICAL PULP BY TREATING THE PULP WITH AN ENZYME HAVING CELLOBIOHYDRALASE ACTIVITY

[75] Inventors: Jaakko Pere, Vantaa; Matti Siika-aho; Liisa Viikari, both of Helsinki, all of Finland

[73] Assignee: Valtion teknillinen tutkimuskeskus, Espoo, Finland

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/513,991

[22] PCT Filed: Mar. 3, 1994

[86] PCT No.: PCT/FI94/00078

§ 371 Date: Feb. 15, 1996

§ 102(e) Date: Feb. 15, 1996

[87] PCT Pub. No.: WO94/20666

PCT Pub. Date: Sep. 15, 1994

[30] Foreign Application Priority Data

Mar. 3, 1993 [FI] Finland ..... 930953

[51] Int. Cl.[7] ..... D21H 25/02

[52] U.S. Cl. ..... 162/24; 162/72; 435/278

[58] Field of Search ..... 162/72, 28, 25, 162/26, 24; 435/277, 278

[56] References Cited

U.S. PATENT DOCUMENTS

| | | | |
|---|---|---|---|
| 5,116,474 | 5/1992 | Fuentes et al. | 162/72 |
| 5,308,449 | 5/1994 | Fuentes et al. | 162/72 |

OTHER PUBLICATIONS

Pilon et al, *Tappi*, "Increasinf Water Retention of Mechanical Pulp by Biological Treatments"; vol. 65, No. 6, Jun. 1982; pp. 93–96.

*Primary Examiner*—Steven Alvo
*Attorney, Agent, or Firm*—Kubovcik & Kubovcik

[57] ABSTRACT

An enzymatic process for treating coarse pulp with an enzyme having cellobiohydrolase activity to reduce the specific energy requirements of the pulp and improve the properties of the pulp. Cellobiohydrolase enzymes isolated from the species *Trichoderma, Aspergillus, Phanerochaete, Penicillium, Streptomyces, Humicola* or *Bacillus* can be used.

22 Claims, No Drawings

PROCESS FOR PREPARING MECHANICAL PULP BY TREATING THE PULP WITH AN ENZYME HAVING CELLOBIOHYDRALASE ACTIVITY

The present invention relates to a process in accordance with the preamble of claim 1 for preparing mechanical pulp.

According to a process of this kind, the wood raw material is disintegrated into chips, which then are defibered to the desired drainability, the raw material being subjected to an enzymatic treatment during the production process.

The invention also relates to an enzyme preparation according to the preamble of claim 15, suitable for the treatment of mechanical pulp.

Chemical and mechanical pulps possess different chemical and fibre technical properties and thus their use in different paper grades can be chosen according to these properties. Many paper grades contain both types of pulps in different proportions according to the desired properties of the final paper products. Mechanical pulp is often used to improve or to increase the stiffness, bulkiness or optical properties of the product.

In paper manufacture the raw material has first to be defibered. Mechanical pulp is mainly manufactured by grinding and refining methods, in which the raw material is subjected to periodical pressure impulses. Due to the friction heat, the structure of the wood is softened and its structure loosened, leading finally to separation of the fibres.

However, only a small part of the energy spent in the process is used to separate the fibres, the major part being transformed to heat. Therefore, the total energy economy of these processes is very poor.

Several methods for improving the energy economy of mechanical pulping are suggested in the prior art. Some of these are based on pretreatment of chips by, e.g., water or acid (FI Patent Specifications Nos. 74493 and 87371). Also known are methods which comprise treating the raw material with enzymes to reduce the consumption of the refining energy. Thus, Finnish Patent Application No. 895676 describes an experiment in which once-refined pulp was treated with a xylanase enzyme preparation. It is stated in the application that this enzyme treatment would, to some extent, decrease the energy consumption. In said prior art publication the possibility of using cellulases is also mentioned, but no examples of these are given nor are their effects shown. As far as isolated, specified enzymes are concerned, in addition to hemicellulases, the interest has been focused on lignin modifying enzymes, such as laccase. A treatment using the laccase enzyme did not, however, lead to decreased energy consumption.

In addition to the afore-mentioned isolated enzymes, the application of growing white rot fungi in the manufacture of mechanical pulps has also been studied. Carried out before defiberization, such a treatment with a white rot fungus has been found to decrease the energy consumption and to improve the strength properties of these pulps. The drawbacks of these treatments are, however, the long treatment time needed (mostly weeks), the decreased yield (85 to 95%), the difficulty to control the process and the impaired optical properties.

The aim of this method of invention is to remove the drawbacks of the known techniques and to provide a completely new method for the production of mechanical pulp.

It is known that the amount and temperature of water bound to wood are of great importance for the energy consumption and quality of the pulp. The water bound to wood is known to decrease the softening temperature of hemicelluloses and lignin between the fibres and simultaneously to weaken the interfibre bonding, which improves the separation of fibres from each other. During refining the energy is absorbed (bound) mainly by the amorphous parts of the fibre material, i.e. the hemicellulose and lignin. Therefore, an increase of the portion of amorphous material in the raw material improves the energy economy of the refining processes.

The invention is based on the concept of increasing the amorphousness of the raw material during mechanical pulping by treating the raw material with a suitable enzyme preparation, which reacts with the crystalline, insoluble cellulose.

The enzymes responsible for the modification and degradation of cellulose are generally called "cellulases". These enzymes are comprised of endo-β-glucanases, cellobiohydrolases and β-glucosidase. In simple terms, even mixtures of these enzymes are often referred to as "cellulase", using the singular form. Very many organisms, such as wood rotting fungi, mold and bacteria are able to produce some or all of these enzymes. Depending on the type of organism and cultivation conditions, these enzymes are produced usually extracellularly in different ratios and amounts.

It is generally well known that cellulases, especially cellobiohydrolases and endoglucanases, act strongly synergistically, i.e. the concerted, simultaneous effect of these enzymes is more efficient than the sum of the effects of the individual enzymes used alone. Such concerted action of enzymes, the synergism, is however, usually not desirable in the industrial applications of cellulases on cellulosic fibres. Therefore, it is often desired to exclude the cellulase enzymes totally or at least to decrease their amount. In some applications very low amounts of cellulases are used for, e.g., removing the fines, but in these applications the most soluble compounds are hydrolyzed to sugars in a limited hydrolysis as a result of the combined action of the enzymes.

In our experiments we have been able to show that a synergistically acting cellulase enzyme product, i.e. the "cellulase" cannot be used to improve the manufacture of mechanical pulps because the application of this kind of enzyme product leads to the hydrolysis of insoluble cellulose and thus impairs the strength properties of the fibres. In connection with the present invention, however, it has surprisingly been found that by using a cellulase enzyme preparation, which does not possess a synergistic mode of action, cellulose can be modified in an advantageous way and desired modifications can be achieved without remarkable hydrolysis or yield losses. Therefore, according to the method of invention a cellulase preparation is used which exhibits a substantial cellobiohydrolase activity and—compared with the cellobiohydrolase activity—a low endo-β-glucanase activity, if any.

Most cellulases are composed of functionally two different domains: the core and the cellulose binding domain (CBD), in addition to the linker region combining these two domains. The active site of the enzyme is situated in the core. The function of the CBD is thought to be mainly responsible for the binding of the enzyme to the insoluble substrate. If the tail is removed, the affinity and the activity of the enzyme towards high molecular weight and crystalline substrates is essentially decreased.

According to the process of the invention, the raw material to be refined is treated with an enzyme, able specifically to decrease the crystallinity of cellulose. This enzyme can be e.g. cellobiohydrolase or a functional part of this enzyme and, as a cellulase enzyme preparation, it acts non-synergistically, as described above. In this context, "functional parts" designate primarily the core or the tail of the enzyme. Also mixtures of the above mentioned enzymes, obtainable by e.g. digestion (i.e. hydrolysis) of the native enzymes can be used. Comparable cellobiohydrolases are also produced by bacteria belonging to the genus of Cellulomonas. The amorphous part of the raw material can also be increased by certain polymerases (e.g. some endoglucanases).

Previously, no method has been presented, wherein only one (or several) biochemically characterized enzyme would have been used as the main activity to achieve a desired modification of the raw material. The prior art contains methods and processes, in which the hydrolytic properties of cellulases are exploited to produce sugars from different cellulosic materials. In these applications, however, the aim is—in contrast to the process of the present invention,—to achieve the most efficient synergistic action of the enzymes.

As used in the present application the term "enzyme preparation" refers to any such product, which contains at least one enzyme or a functional part of an enzyme. Thus, the enzyme preparation may be a culture filtrate containing one or more enzymes, an isolated enzyme or a mixture of two or several enzymes. "Cellulase" or "cellulase enzyme preparation", on the other hand, refers to an enzyme preparation containing at least one of the before mentioned cellulase enzymes.

For the purpose of the present application, the term "cellobiohydrolase activity" denotes an enzyme preparation, which is capable of modifying the crystalline parts of cellulose. Thus, the term "cellobiohydrolase activity" includes particularly those enzymes, which produce cellobiose from insoluble cellulose substrates. This term covers, however, also all enzymes, which do not have a clearly hydrolyzing effect or which only partially have this effect but which, in spite of this, modify the crystalline structure of cellulose in such a way that the ratio of the crystalline and amorphous parts of the lignocellulosic material is diminished, i.e. the part of amorphous cellulose is increased. These last-mentioned enzymes are exemplified by the functional parts of e.g. cellobiohydrolase together or alone.

According to the process of the present invention, the enzyme treatment is preferably carried out on the "coarse pulp" of a mechanical refining process. This term refers in this application to a lignocellulosic material, used as raw material of the mechanical pulp and which already has been subjected to some kind of fiberizing operation during mechanical pulping e.g. by refining or grinding. Typically, the drainability of the material to be enzymatically treated, is about 30 to 1,000 ml, preferably about 100 to 700 ml. When applied directly to the chips, the enzyme treatment is usually not as efficient, because it is difficult to achieve an efficient diffusion (adsorption) of the enzyme preparation into the fibres of the raw material, if still in the form of chips. In contrast, e.g. a pulp, once refined, is well suited for use in the method of invention. The term coarse pulp thus encompasses, e.g., once refined or ground pulp, the rejects and long fibre fractions, and combinations of these, which have been produced by thermomechanical pulping (e.g. TMP) or by grinding (e.g. GW and PGW). It is essential for the invention that the enzyme treatment be carried out at least before the final refining stage, where the material is refined to the desired freeness, which is typically less than 300 ml CSF, preferably less than 100 ml CSF.

The process is not limited to a certain wood raw material, but it can be applied generally to both soft and hard wood species, such as species of the order of *Pinacae* (e.g. the families of Picea and Pinus), *Salicaceae* (e.g. the family of Populus) and the species in the family of Betula.

According to the present invention the parts, in particular the core of the cellobiohydrolase enzyme can be used instead of the cellobiohydrolase for the manufacture of mechanical pulps. It has, namely, been observed that used in connection with the present process, that parts of the enzyme, in particular the core, have a similar, although weaker hydrolytic effect as the intact enzyme. Also the tail of the cellobiohydrolase enzyme has been observed to modify cellulose and is therefore suitable for the present invention.

According to a preferred embodiment the once-refined mechanical pulps of CSF values of 30 to 1,000 ml are treated with the cellobiohydrolase enzyme preparation at 30 to 90° C., in particular at 40 to 60° C., at a consistency of 0.1 to 20%, preferably 1 to 10%. The treatment time is 1 min to 20 h, preferably about 10 min to 10 h, in particular about 30 min to 5 h. The pH of the treatment is held neutral or slightly acid or alkaline, a typical pH being 3 to 10, preferably about 4 to 8. The enzyme dosage varies according to the type of pulp and the cellobiohydrolase activity of the preparation, but is typically about 1 $\mu$g to 100 mg of protein per gram of od. pulp. Preferably, the enzyme dosage is about 10 $\mu$g to 10 mg of protein per gram of pulp.

The process according to the present invention can be combined with treatments carried out with other enzymes, such as hemicellulases (e.g. xylanases, glucuronidases and mannanases) or esterases. In addition to these enzymes, additional enzyme preparations containing β-glucosidase activity can be used in the present process, because this kind of β-glucosidase activity prevents the end product inhibition and increases the efficiency of the method.

Cellobiohydrolase enzyme preparations are produced by growing suitable micro-organism strains, known to produce cellulase. The production strains can be bacteria, fungi or mold. As examples, the micro-organisms belonging to the following species can be mentioned:

*Trichoderma* (e.g. *T. reesei*), *Aspergillus* (e.g. *A. niger*), *Fusarium, Phanerochaete* (e.g. *P. chrysosporium*; [Covert, S., Vanden Wymelenberg, A. & Cullen, D., Structure, organisation and transcription of a cellobiohydrolase gene cluster from *Phanerochaete chrysosporium,* Appl. Environ. Microbiol. 58 (1992), 2168–2175], *Penicillium* (e.g. *P. janthinellum, P. digitatum*), *Streptomyces* (e.g. *S. olivochromogenes, S. flavogriseus*), *Humicola* (e.g. *H. insolens*), *Cellulomonas* (e.g. *C. fimi*) and *Bacillus* (e.g. *B. subtilis, B. circulans*, [Ito, S., Shikata, S., Ozaki, K., Kawai, S., Okamoto, K., Inoue, S., Takei, A., Ohta, Y. & Satoh, T., Alkaline cellulase for laundry detergents: production by *Bacillus sp.* KSM-635 and enzymatic properties, Agril. Biol. Chem. 53 (1989), 1275–1281]. Also other fungi can be used, strains belonging to species, such as *Phlebia, Ceriporiopsis* and *Trametes.*

It is also possible to produce cellobiohydrolases or their functional parts with strains, which have been genetically improved to produce specifically these proteins or by other genetically modified production strains, to which genes, coding these proteins, have been transferred. When the genes coding the desired protein(s) (Teeri, T., Salovuori, I. & Knowles, J., The molecular cloning of the major cellobiohydrolase gene from *Trichoderma reesei* Bio/Technology 1 (1983), 696–699) have been cloned it is possible to produce the protein or its part in the desired host organism. The desired host may be the fungus *T. reesei* (Mitsuishi, Y., Nitisinprasert, S., Saloheimo, M., Biese, I., Reinikainen, T., Clayssens, M., Keränen, S., Knowles, J. & Teeri, T., Site-directed mutagenesis of the putative catalysic residues of *Trichoderma reesei* cellobiohydrolase I and endoglucanase I, FEBS Lett. 275 (1990), 135–138), a yeast (Penttilä, M., Antre, L., Lehtovaara, P., Bailey, M., Teeri, T. & Knowles, J., Efficient secretion of two fungal cellobiohydrolases by *Saccharomyces cerevisiae.* Gene 63 (1988) 103–112) or some other fungus or mold, from species such as *Aspergillus* (19), a bacterium or any other micro-organism, whose genome is sufficiently known.

According to a preferred embodiment the desired cellobiohydrolase is produced by the fungus *Trichoderma reesei.* This strain is a generally used production organism and its cellulases are fairly well known. *T. reesei* synthesizes two cellobiohydrolases, which are later referred to as CBH I and CBH II, several endoglucanases and at least two β-glucosidases (Chen, H., Hayn, M. & Esterbauer, H., Purification and characterization of two extracellular β-glucosidases from *Trichoderma reesei,* Biochim. Biophys. Acta 1121 (1992) 54–60). The biochemical properties of these enzymes have been extensively described on pure cellulosic substrates. Endoglucanases are typically active on soluble and amorphous substrates (CMC, HEC, β-glucan), whereas the cellobiohydrolases are able to hydrolyze only crystalline cellulose. The cellobiohydrolases act clearly synergistically on crystalline substrates, but their hydrolysis mechanisms are supposed to be different from each other. The present knowledge on the hydrolysis mechanism of cellulases is based on results obtained on pure cellulose substrates, and may not be valid in cases, where the substrate contains also other components, such as lignin or hemicellulose.

The cellulases of *T. reesei* (cellobiohydrolases and endoglucanases) do not essentially differ from each other with respect to their optimal external conditions, such as pH or temperature. Instead they differ from each other with respect to their ability to hydrolyze and modify cellulose in the wood raw material.

As far as their enzymatic activities are concerned, the cellobiohydrolases I and II differ also to some extent from each other. These properties can be exploited in the present invention. Therefore, it is particularly preferable to use cellobiohydrolase I (CBH I) produced by *T. reesei* according to the present invention for reducing the specific energy consumption of mechanical pulps. The pI value of this enzyme is, according to data presented in the literature, 3.2 to 4.2 depending on the form of the isoenzyme (20) or 4.0 to 4.4, when determined according to the method presented in Example 2. The molecular weight is about 64,000 when determined by SDS-PAGE. It must be observed, however, that there is always an inaccuracy of about 10% in the SDS-PAGE method. Cellobiohydrolases alone or combined to e.g. hemicellulases can be particularly preferably used for the modification of the properties of mechanical pulps, e.g. for improving the technical properties of the paper (i.e. the handsheet properties) prepared from these pulps. Naturally, also mixtures of cellobiohydrolases can be used for the treatment of pulps, as described in Example 6.

Cellobiohydrolase can be separated from the culture filtrates of the fungus *Trichoderma reesei* by several conventional, known methods. Typically, in these separation and isolation methods several different purification techniques, such as precipitation, ion exchange chromatography, affinity chromatography and gel permeation chromatography can be used and combined. By using affinity chromatography, cellobiohydrolase can be separated easily even directly from the culture filtrate (van Tilbeurgh, H. Bhikhabhai, R. Pettersson, L. and Claeyessens M. (1984), Separation of endo- and exo-type cellulases using a new affinity method. FEBS Lett. 169, 215–218). The preparation of the gel material needed for this affinity chromatography is, however, difficult and this material is not commercially available. According to a preferred embodiment of the invention, the cellobiohydrolase I enzyme is separated from the other proteins of the culture filtrate by a rapid purification method, based on anion exchange. This method is described in detail in Example 1. The method of invention is not, however, limited to this isolation method of proteins, but it is also possible to isolate or enrich the desired protein by other known methods.

Significant advantages can be obtained with this invention. Thus, with this method the specific energy consumption can be remarkably decreased; as the examples described below show, an energy saving of up to 20% can be achieved using the method of invention, as compared with untreated raw materials. Using a suitable cellobiohydrolase, also the properties of the pulp can be improved. According to the method of invention, in which the synergistic action of the enzyme preparation used is absent or only insignificant, also the problems involved in the above mentioned fungal treatments can be avoided. Thus, the treatment time lasts only for few hours, the yield is extremely high, the quality of the pulp is good and the connection of the method to the present processes is simple.

The method can be applied in all mechanical or semi-mechanical pulping methods, such as in the manufacture of ground wood (GW, PGW), thermomechanical pulps (TMP) and chemimechanical pulps (CTMP).

In the following the invention will be examined in more detail with the aid of the following non-limiting examples.

EXAMPLE 1

Purification of Cellobiohydrolase I

The fungus *Trichoderma reesei* (strain VTT-D-86271, RUT C-30) was grown in a 2 $m^3$ fermenter on a media containing 3% (w/w) Solka floc cellulose, 3% corn steep liquor, 1.5% $KH_2PO_4$ and 0.5% $(NH_4)_2SO_4$. The temperature was 29° C. and the pH was controlled between 3.3 and 5.3. The culture time was 5 d, whereafter the fungal mycelium was separated by a drum filter and the culture filtrate was treated with bentonite, as described by Zurbriggen et al. (Zurbriggen, B. Z., Bailey, M. J., Penttilä, M. E., Poutanen, K. and Linko M. (1990), Pilot scale production of heterologous *Trichoderma reesei* cellulase in *Saccharomyces cerevisiae.* J. Biotechnol. 13, 267–278). After this the liquor was concentrated by ultrafiltration.

The isolation of the enzyme was started by buffering the concentrate by gel filtration to pH 7.2 (Sephadex G-25 coarse). The enzyme solution was applied at this pH (7.2) to an anion exchange chromatography column (DEAE-Sepharose FF), to which most of the proteins in the sample, including CBH I, were bound. Most of the proteins bound to the column including also other cellulases than CBH I were eluated with a buffer (pH 7.2) to which sodium chloride was added to form a gradient in the eluent buffer from 0 to 0.12 M. The column was washed with a buffer at pH 7.2, containing 0.12 M NaCl, until no significant amount of protein was eluted. CBH I was eluted by increasing the concentration of NaCl to 0.15 M. The purified CBH I was collected from fractions eluted by this buffer.

EXAMPLE 2

Characterization of CBH I

The protein properties of the enzyme preparation purified according to example 1 were determined according to usual methods of protein chemistry. The isoelectric focusing was run using a Pharmacia Multiphor II System apparatus according to the manufacturer's instructions using a 5% polyacrylamide gel. The pH gradient was achieved by using a carrier ampholyte Ampholine, pH 3.5–10 (Pharmacia), where a pH gradient between 3.5 and 10 in the isoelectric focusing was formed. A conventional gel electrophoresis under denaturating conditions (SDS-PAGE) was carried out according to Laemmli, (Laemmli, U. K., Cleavage of structural proteins during the assembly of the head of bacteriophage T4. Nature 227 (1970), 680–685; Chen H., Hayn M. & Esterbauer H. Purification and characterization of two extracellular β-glucosidases from *Trichoderma reesei*. Biochim. Biophys. Acta 1121 (1992), 54–60), using a 10% polyacrylamide gel. In both gels the proteins were stained with silver staining (Bio Rad, Silver Stain Kit).

For CBH I the molecular weight obtained was 64,000 and the isoelectric point 4.0–4.4. As judged from the gels, over 90% of the proteins consisted of CBH I.

EXAMPLE 3

Enzymatic Treatment

The ability of the enzyme produced and characterized according to the examples 1 and 2 to hydrolyze coarse wood fibres (spruce) were studied and compared with other cellulases. The enzyme dosage was 0.5 mg/g of pulp and the hydrolysis conditions were: pH 5–5.5. temperature 45° C., hydrolysis time 24 h. The results are described in Table 1. It is noteworthy that cellobiohydrolases alone did not achieve substantial formation of sugars and thus not yield losses.

TABLE 1

Hydrolysis of coarse pulp (spruce) with different cellulases

| Enzyme | Reducing sugars,g/l | Degree of hydrolysis, % of d.w. |
|---|---|---|
| CBH I | 0.003 | 0.01 |
| CBH II | 0.05 | 0.1 |
| EG I | 0.06 | 0.12 |
| EG II | 0.04 | 0.08 |

EXAMPLE 4

Effect of Enzymatic Treatment on the Swelling of Fibres

The long fibre fraction (+48) of the fractionated TMP spruce pulp was treated with cellulases at 5% consistency at 45° C. for 24 hours. The pulp was suspended in tap water and pH was adjusted between 5–5.5 using diluted sulphuric acid. The enzyme dosage was 0.5 mg/g of dry pulp. After the treatment the pulp was washed with water and the WRV (water retention value) describing the swelling of the fibres was determined by a SCAN method. The results are presented in Table 2.

TABLE 2

Swelling of spruce fibres after the enzymatic treatment

| Enzyme | WRV, % |
|---|---|
| CBH I | 108 |
| Control | 102 |

According to the results CBH I is able to modify the pulp by increasing the ability to adsorb water, which improves the refining.

EXAMPLE 5

Effect of Enzyme Treatment on the Flexibility of the Fibres

The long fibre fraction (+48) of the fractionated TMP spruce pulp was treated with CBH I at 5% consistency at 45° C. for 2 hours. The enzyme dosage was 1 mg CBH/g of dry pulp. After the treatment the flexibility of the fibres was measured using a hydrodynamic method. From each sample the flexibility of 100–200 individual fibres was measured. The results are presented in Table 3. According to the results the stiffness of the fibres was decreased; i.e. flexibility of the fibres was increased after the CBH treatment.

TABLE 3

The effect of the enzyme treatment on the flexibility (stiffness) of the fibres

| Flexibility index ($10^{-12}$ $Nm^2$) | Control | CBH I |
|---|---|---|
| Smallest value | 2.7 | 2.1 |
| Lower quartile | 6.2 | 7.2 |
| Median | 16.8 | 14.2 |
| Upper quartile | 27.4 | 21.8 |
| Greatest value | 45.5 | 40.2 |
| Mean | 17.7 | 15.8 |
| Standard deviation | 11.2 | 9.6 |

EXAMPLE 6

Effect of Enzymatic Treatment on the Specific Energy Consumption of Refining In three independent series, coarse once refined TMP pulps, with freeness values (CSF) of 450–550 ml, were treated with CBH I enzyme preparation. The consistency of the pulp suspension in each experiment was 5% in tap water, the treatment time 2 h and temperature 45–50° C. The amount of pulp treated was 1 kg of dry pulp and the enzyme dosage 0.5 mg/g of pulp. After the enzyme treatment the pulps were drained, centrifuged and homogenized. The reference samples were treated in the same way, but without enzyme addition.

The pulps were further refined using a Bauer or a Sprout Waldron single rotating disk atmospheric refiner using decreasing plate settings. The refining was followed by determining the freeness values of the intermediate samples and stopped when the freeness values were below 100 ml. The energy consumption in each refining experiment was measured and the specific energy consumption was calculated and reported as kWh/kg o.d. weight basis. The results are presented in Table 4.

TABLE 4

The specific energy consumption on untreated samples and the CBH I and CBH I/CBH II treated samples in four independent test series. The values of the specific energy consumption are reported at the CSF level of 100 ml.

| Sample | Test 1 kWh/kg | Test 2 kWh/kg | Test 3 kWh/kg | Test 4 kWh/kg |
|---|---|---|---|---|
| CBH I | 1.73 | 1.64 | 2.04 | 1.81 |
| CBH I digested | — | — | — | 1.76 |
| CBH I/CBH II | — | — | — | 1.77 |
| Controls | 1.97 | 2.05 | 2.39 | 2.08 |

It can be observed from the results obtained that it is possible to reduce the energy consumption by using the CBH I enzyme by 15–20% as compared with the reference sample. The same effect was also obtained, when the preparation contained both cellobiohydrolase activities or the proteolytically digested CBH. The latter enzyme preparation contained both functional domains of CBH I i.e. the core and the CBD.

EXAMPLE 7

Effect of the Enzyme Treatment on Handsheet Properties of the Pulps

Spruce TMP pulp was treated with an enzyme preparation containing CBH I and CBH II and further refined. Improvment of the strength properties of enzyme treated pulp can be observed as compared to the untreated control.

TABLE 5

Strength properties of the CBH I + CBH II treated sample and the untreated control at the CSF level of 150 ml

| Sample | Tensile index, Nm/g | Tear index, $mNm^2/kg$ |
|---|---|---|
| Control | 31.3 | 7.0 |
| CBH I + CBH II | 32.0 | 7.2 |

EXAMPLE 8

Effect of the Enzyme Treatment on the Crystallinity of Cellulose

Spruce TMP pulps were treated with the intact cellobiohydrolases and with the digested CBHs. Decrease in the crystallinity of the pulp was detected. The same effect was not observed with endoglucanases (EG I and EG II).

We claim:

1. A process for preparing mechanical pulp from wood raw-material, which comprises:

(i) refining or grinding wood raw material to obtain a coarse pulp having a drainability of from about 30 to 1,000 CSF;

(ii) treating the coarse pulp with an enzyme having a cellobiohydrolase activity effective for modifying crystalline parts of cellulose and as compared with the cellobiohydrolase activity, a low endo-β-glucanase activity, wherein the endo-β-glucanase activity is less than that which will significantly hydrolyze the cellulose; and (iii) mechanically defibering the enzyme treated coarse pulp to lower the freeness to a value of less than 300 ml CSF.

2. A process according to claim 1, wherein an enzyme preparation is used, which contains isolated cellobiohydrolase enzymes or parts thereof.

3. A process according to claim 1, wherein an enzyme preparation is used, which has been produced by cultivating on a suitable growth medium a microorganism strain belonging to the species *Trichoderma, Aspergillus, Phanerochaete, Penicillium, Streptomyces, Humicola* or *Bacillus*.

4. A process according to claim 3, wherein the enzyme preparation used has been produced by a strain genetically improved for producing an enzyme having cellobiohydrolase activity, or by a strain to which the gene coding for said activity has been transferred.

5. A process according to claim 4, wherein the cellobiohydrolase enzyme used has been separated from the other proteins of the growth medium by a purification method based on rapid anionic ion exchange.

6. A process according to claim 3, wherein the cellobiohydrolase enzyme used has been separated from the other proteins of the growth medium by a purification method based on rapid anionic ion exchange.

7. A process according to claim 1, wherein the enzyme preparation used contains cellobiohydrolase produced by the microorganism *Trichoderma reesei*.

8. A process according to claim 7, wherein the cellobiohydrolase enzyme used has been separated from the other proteins of the growth medium by a purification method based on rapid anionic ion exchange.

9. A process according to claim 7, wherein the enzyme preparation used contains the cellobiohydrolase I (CBH I) produced by the fungus strain *Trichoderma reesei* having a molecular weight, determined by SDS-PAGE, of about 64,000 and an isoelektric point of about 3.2 to 4.4.

10. A process according to claim 1, wherein the enzyme treatment is carried out at 30 to 90° C. and at a consistency of about 0.1–20%, the duration of the treatment being about 1 min–20 h.

11. A process according to claim 10, wherein the enzyme treatment is carried out at about 40 to 60° C.

12. A process according to claim 11, wherein the enzyme treatment is carried out at a consistency of about 0.1–10%.

13. A process according to claim 12, wherein the duration of the treatment is about 30 min–5 h.

14. A process according to claim 11, wherein the duration of the treatment is about 30 min–5 h.

15. A process according to claim 10, wherein the enzyme treatment is carried out at a consistency of about 0.1–10%.

16. A process according to claim 10, wherein the duration of the treatment is about 30 min–5 h.

17. A process according to claim 1, wherein the enzyme preparation is dosaged in an amount of about 10 μg–100 mg protein per gram of dry pulp.

18. A process according to claim 17, which comprises enzymatically treating coarse pulp having a drainability of about 300 to 700 ml CSF.

19. A process according to claim 17, wherein the enzyme preparation is dosaged in an amount of about 100 μg–10 mg protein per gram of dry pulp.

20. A process according to claim 1, wherein the mechanical pulp is prepared by the GW, PGW, TMP or CTMP process.

21. A process for preparing mechanical pulp from wood raw-material, which comprises:

(i) refining or grinding wood raw material to obtain a coarse pulp having a drainability of from about 30 to 1,000 CSF; and (ii) increasing the amorphous portion of said coarse pulp by treating the coarse pulp with an enzyme having a cellobiohydrolase activity effective for modifying crystalline parts of cellulose and as compared with the cellobiohydrolase activity, a low endo-β-glucanase activity, wherein the endo-β-glucanase activity is less than that which will significantly hydrolyze the cellulose; and (iii) mechanically defibering the enzyme treated coarse pulp to lower the freeness to a value of less that 300 ml CSF.

22. A process according to claim 21, wherein an enzyme preparation is used, which contains isolated cellobiohydrolase enzymes or parts thereof.

* * * * *